United States Patent [19]

Charquet et al.

[11] Patent Number: 4,764,223

[45] Date of Patent: Aug. 16, 1988

[54] PROCESS FOR THE MANUFACTURE OF A ROUGH-SHAPED, COLD-ROLLED CLADDING TUBE OF ZIRCONIUM ALLOY

[75] Inventors: Daniel Charquet; Yvon Millet, both of Albertville; Marc Dall'Agnol, Mercury; Réne Robin, Gilly/sur/Isere, all of France

[73] Assignee: Pechiney, Cedex, France

[21] Appl. No.: 765,102

[22] Filed: Aug. 13, 1985

[30] Foreign Application Priority Data

Jun. 27, 1985 [FR] France ..... 85 10373

[51] Int. Cl.[4] ..... C22F 1/18

[52] U.S. Cl. ..... 148/11.5 F; 148/421

[58] Field of Search ..... 148/11.5 F, 421, 2

[56] References Cited

FOREIGN PATENT DOCUMENTS 1327734 4/1963 France .

OTHER PUBLICATIONS

*Chemical Abstracts,* vol. 103, No. 8, 1985, p. 245; &

JP-A-60 50 155 (Toshiba Corp. Nippon Atomic Industry Group Co., Ltd. 19-03-1985).

EP-A-0 098 996 (Hitachi Ltd.), revendications 1-4, p. 12, line 19-p. 14, line 20.

*Primary Examiner*—R. Dean

*Attorney, Agent, or Firm*—Oblon, Fisher, Spivak, McClelland & Maier

[57] ABSTRACT

A process for the manufacture of a rough-shaped, cold-rolled cladding tube of "Zircaloy 2" or "Zircaloy 4", in which (a) an ingot of the alloy is transformed by hot working and the bar obtained is cut up into billets, (b) the bar or the billet is then immersed from the $\beta$ range, (c) at least one billet which has thus been immersed is extruded in the $\alpha$ range, (d) the rough shape extruded is cold-rolled and heat-treated to give rise to a cold-rolled, rough-shaped cladding tube, wherein the hot working is first carried out in the $\beta$ range with a cross-sectional reduction ratio of at least 1.5 and then in the $\alpha$ range with a cross-sectional reduction ratio of at least 3, is disclosed.

4 Claims, No Drawings

PROCESS FOR THE MANUFACTURE OF A ROUGH-SHAPED, COLD-ROLLED CLADDING TUBE OF ZIRCONIUM ALLOY

BACKGROUND OF THE INVENTION

1. Field of the Invention

This invention relates to a process for the manufacture of a rough-shaped, cold-rolled cladding tube of zirconium alloy.

2. Discussion of the Background

It is known that a "Zircaloy 2" or "Zircaloy 4" ingot (classified according to the ASTM-B352 specification "grades" R 60802 and R 60804) can be transformed by hot-working either completely in the $\beta$ range at a temperature of from 900° to 1040° C., or completely in the $\alpha$ range, typically at temperatures of from 700° to 790° C. After hot-working, billets cut out of the rolled bar or bars are quenched in water after preheating in the $\beta$ range, and are then extruded in the $\alpha$ range in the form of hollow rough shapes. These extruded hollow rough shapes are then subjected to a surface treatment followed by cold-rolling and one or more reheating treatments in the range and are thereby converted into cold-rolled, rough-shaped cladding tubes.

These cold-rolled shapes are then again rolled in the cold in several passes and heat-treated to give cladding tubes. When the hot-working is carried out in the $\beta$ range, rolling can be effected much more rapidly than in the $\alpha$ range. The present invention relates to increasing the suitability of these cold-rolled, rough-shapes to be re-rolled in the cold, while preserving at least part of the hot-working in the $\beta$ range.

SUMMARY OF THE INVENTION

Accordingly, it is an object of this invention to provide a novel process for the manufacture of a rough-shaped, cold-rolled cladding tube of zirconium alloy "Zircaloy 2" or "Zircaloy 4". Such a process as used in the prior art comprises the following stages:

(a) An ingot of the zirconium alloy is converted by hot-working to the form of a bar. The worked bar obtained is cut up into billets. A substantially coaxial hole is pierced in a billet and this billet is machined.

(b) Either the worked bar before it has been cut up into billets, or at least one billet before or after it has been perforated, is quenched in water from the $\beta$ range.

(c) At least one perforated and quenched billet is extruded as a rough-shape in the $\alpha$ range.

(d) At least one extruded rough shape is cold-rolled and subjected to heat treatment in the form of one or several intermediate and/or final annealing stages to form a rough-shape of cold-rolled cladding tube.

In accordance with the present invention, the hot-working is first carried out in the $\beta$ range, typically at a temperature of from 960° to 1050° C. by a process of rolling or forging with a reduction ratio "S/s" (initial cross-section/final cross-section) of at least 1.5. This allows that the advantage of rapid working, which is important economically, be preserved for the beginning of the hot transformation of a workpiece having a large diameter and large thickness. Hot-working working is then subsequently carried out in the $\alpha$ range, typically in the upper part of this range, at a temperature of from 740° to 790° C., with a cross-sectional reduction ratio "S/s" of at least 3.

The present invention also provides a novel rough-shaped, cold-rolled cladding tube of zirconium alloy made in accordance with the above process.

DETAILED DESCRIPTION OF THE PREFERRED EMBODIMENT

According to the prior art, a process for the manufacture of a rough-shaped, cold-rolled cladding tube of zirconium alloy "Zircaloy 2" and "Zircaloy 4" includes the following steps.

(a) An ingot of the zirconium alloy is converted by hot-working to the form of a bar. The rolled bar obtained is cut up into billets. A substantially coaxial hole is pierced in a billet and this billet is machined.

(b) Either the worked bar before it has been cut up into billets, or at least one billet before or after it has been perforated is quenched in water from the $\beta$ range.

(c) At least one perforated and quenched billet is extruded as a rough shape in the $\alpha$ range.

(d) At least one extruded rough-shape is cold-rolled and subjected to heat treatment in the form of one or several intermediate and/or final annealing stages to form a rough-shape of cold-rolled cladding tube.

In the present invention, the hot working is first carried out in the $\beta$ range, typically at a temperature of from 960° to 1050° C., by a process of rolling or forging with a reduction ratio, "S/s", (initial cross-section/final cross-section) of at least 1.5, and preferably from 1.5 to 3. This permits that the economically important advantage of rapid working is preserved for the beginning of the hot transformation of workpiece having a large diameter and a large thickness. Hot working is then subsequently carried out in the $\alpha$ range, typically in the upper part of this range at a temperature of from 740° C. to 790° C., with a cross-sectional reduction ratio "S/s" of at least 3, and preferably from 5 to 8.

This mixed working, first in the $\beta$ range and then in the $\alpha$ range, surprisingly provides, in addition to a more efficacious process, the following advantages as compared with hot-rolling in the $\beta$ range alone:

The aptitude of the cold-rolled, rough-shapes of cladding tubes for re-rolling in the cold is greatly improved. The deformation ratio obtainable in one rolling pass is increased from 50–60% to at least 80%. This deformation ratio is equal to $(1\text{-sl/so})\times 100$, where "so" is the cross-section before deformation and "sl" is the cross-section after deformation;

The eccentricity of the rough shapes obtained is appreciably reduced. Thus in the case of the tests described below, statistical calculation shows that when hot-working is carried out first in the $\beta$ range and then in the $\alpha$ range, 99.7% of the tubes have an eccentricity ratio below 4.3%, whereas when hot-working is carried out entirely in the $\beta$ range, 99.7% of the tubes have an eccentricity ratio below 6%.

As will be even more apparent from the examples below, the present invention thus provides a solution to problems associated with the prior art, and also provides unexpected advantages.

The following descriptions of exemplary embodiments are given below for purposes of illustration of the invention and are not intended to be limiting thereof.

Reference tests

"Zircaloy 4" ingots containing the following impurities on average (by weight): Sn=1.5%, Fe=0.2%, Cr=0.1, O=0.11%, C=130 ppm, H=10 ppm, and Zr as the remainder, were hot-worked in the $\beta$ range. The preheating temperature was 1030° C., and via hot-working ingots having a 600 mm diameter were transformed into bars having a 177 mm diameter. These bars were machined into billets of about 60 kg having an external diameter of 168 mm and length of 430 mm. The billets were then quenched in water at a temperature of from 1020° to 1080° C., and were then perforated so that their internal diameter was 50.5 mm. Finally, the billets were preheated by induction heating to a temperature of from 590° to 650° C. and extruded with lubricant into rough shapes having an external diameter of 80 mm and an internal diameter of 51 mm.

The extruded shapes were then subjected to a surface preparation consisting of mechanical polishing followed by pickling in a fluoronitric bath.

The pickled, extruded rough shapes were then rolled and annealed under vacuum at 640° C. to form rough-shaped, cold-rolled cladding tubes having an external diameter of 63.5 mm and a thickness of 10.9 mm.

The following observations and tests were carried out on these ingots and transformed rough shapes within the usual ranges:

(a1) The billets which had been steeped in water from the $\beta$ range (1020° to 1071° C.) showed, in section, dispersed figures of ex-beta grain from 1 to 5 mm.

(b1) When the eccentricities were measured in the process of controlling the cold-rolled shapes having a diameter of 63.5 mm and a thickness of 10.9 mm, a total of 100 of these shapes conforming to current production gave the following statistical results:

Average eccentricity ratio: 3.6%

Standard deviation: 0.8% amounting to an eccentricity ratio below $3.6+(3\times0.8)=6\%$ for 99.7% of the shapes;

(c1) On these cold rolled rough shapes having a diameter of 63.5 mm and a thickness of 10.9 mm, the first conventional cold re-rolling transformed the shapes into rough-shaped tubes having a diameter of 44.5 mm and a thickness of 7.6 mm, amounting to a deformation ratio of 51%.

Attempts were made to re-roll several of these cold rolled shapes directly to the dimenstion of $\phi30\times$thickness 4.5 mm, amounting to a deformation ratio of 80% in a single pass. Ultrasonic control under immersion carried out on the cladding tubes obtained from these rough shapes showed up many fissures. The cold-rolled, rough-shapes obtained from the hot-rolled bars thus do not give rise to cladding tubes of high quality except in the case of a deformation ratio in the cold of 51%, but do not support a deformation ratio of 80%.

Test according to the invention

A Zircaloy 4 ingot, reference "36", containing the following impurities (by weight): Sn=1.45%, Fe=0.21%, Cr=0.11%, O=0.116%, C=136 ppm, H=12 ppm, and Zr as the remainder, was used for the test.

Hot-working was carried out on a portion of this ingot as follows:

Rough working from a 600 mm diameter to an octagonal shape of 440 mm, amounting to a reduction ratio of the cross-section of 1.8, by forging following a preheating to 1030° C.

Re-cooling followed by reheating in the upper region of the $\alpha$ range at 780° C., and forging the octagon to a diameter of 250 mm and then to an octagon of 177 mm. The reduction ratio in the $\alpha$ range corresponding to the transformation of the octagon of 440 mm to a circular shape of 177 mm, was 6.5.

The bars having a diameter of 177 mm were then transformed into billets, into rough extruded shapes and into cold-worked rough shaped cladding tubes under the same conditions as those employed in the reference tests. The following observations and tests were then carried out:

(a2) The billets quenched in water from the $\beta$ range obtained from hot-worked bars according to the invention were found in section to have a homogeneous ex-beta grain structure of about 1.5 mm. The refinement of the structure due to partial rolling in the $\alpha$ range was evident.

(b2) The eccentricities measured on 14 rough shapes according to the invention having a diameter of 63.55 by 10.9 mm in thickness were as follows:

Minimum eccentricity ratio 2.5% (4 rough shapes); maximum 4% (1 rough shape)

mean eccentricity ratio: 3.0% standard deviation: 0.44%, amounting to an eccentricity ratio of less than $3+(3\times0.44)=4.32\%$ for 99.7% of the rough shapes.

(c2) Four of these rough-shaped, cold-rolled cladding tubes according to the invention were reheated under vacuum at 640° C. and directly re-rolled in the cold to dimensions of a diameter of 30 mm and a thickness of 4.5 mm (deformation ratio=80%) and then reheated and rolled to form cladding tubes. Ultrasonic control of these cladding tubes having an external diameter of 10.5 mm and a thickness of 0.8 mm, did not reveal any fissures. The aptitude for re-rolling cold rolled shapes in the cold according to the invention is thus highly improved.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the Unites States is:

1. A process for the manufacture of a rough-shaped, cold-rolled cladding tube of zirconium alloy, Zircaloy 2 or Zircaloy 4, said process comprising:

(a) transforming an ingot of the said zirconium alloy to the form of a bar by hot-working; cutting the worked bar obtained into billets; piercing a hole substantially coaxially in one of the said billets; and machining this billet;

(b) quenching in water, from the $\beta$ range, either the worked-bar before it is cut into billets or at least one of the said billets before or after piercing;

(c) extruding in the $\alpha$ range at least one of the said perforated and quenched billets in the form of an extruded rough-shaped; and (d) cold-rolling and heat-treating at least one of the said extruded rough-shape to produce a cold-rolled, rough-shaped cladding tube;

wherein the said process is characterized in that the said hot-working is first carried out in the $\beta$ range at a temperature of from 960° to 1050° C. with a cross-sectional reduction ratio of from 1.5 to 3, and then in the $\alpha$ range at a temperature from 740° to 790° C. with a cross-sectional reduction ratio of at least 3.

2. The process of claim 1, wherein after the said hot-working in the $\beta$ range, hot-working is carried out in the α range with a cross-sectional reduction ratio of from 5 to 8.

3. The process of claim 1, wherein said hot-working is first carried out in the β range at a temperature of from 960° to 1050° C. with a cross-sectional reduction ratio of from 1.5 to 3, and then in the α range at a temperature of from 740° to 790° C. with a cross-sectional reduction ratio of at least 3, wherein said hot-working is carried out without intermediate quenching.

4. The process of claim 2, wherein said hot-working is carried out in the β range at a temperature of from 960° to 1050° C. with a cross-sectional reduction ratio of from 1.5 to 3, and then in the α range at a temperature of from 740° to 790° C. with a cross-sectional reduction ratio of from 5 to 8, wherein said hot-working is carried out without intermediate quenching.

* * * * *